US005375528A

United States Patent [19]

Brinkman et al.

[11] Patent Number: 5,375,528

[45] Date of Patent: Dec. 27, 1994

[54] CONTAINER FOR A LARGE SPHERICAL EXPLOSIVE CHARGE

[76] Inventors: John A. Brinkman, 2242 Salt Air Dr., Santa Ana, Calif. 92705; Leon Shenfil, 5421 Via Vicente, Yorba Linda, Calif. 92687; Donald N. Thatcher, 3338 E. Rosemonte Dr., Phoenix, Ariz. 85024

[21] Appl. No.: 19,371

[22] Filed: Feb. 18, 1993

[51] Int. Cl.[5] ..... F42B 3/00

[52] U.S. Cl. ..... 102/331; 102/302; 102/332; 102/282; 102/324

[58] Field of Search ..... 102/302, 331, 332, 466, 102/282, 324

[56] References Cited

U.S. PATENT DOCUMENTS

| | | | |
|---|---|---|---|
| 289,761 | 12/1883 | Divine et al. | 102/324 X |
| 1,638,038 | 8/1927 | Jenkins | 102/332 X |
| 3,687,076 | 8/1972 | Friant et al. | 102/331 |
| 3,760,727 | 9/1973 | Callister et al. | 102/331 X |
| 3,771,460 | 11/1973 | Ayer | 102/332 X |
| 3,955,504 | 5/1976 | Romney | 102/331 |
| 4,205,611 | 6/1980 | Slawinski | 102/324 |
| 4,369,711 | 1/1983 | Leader | 102/324 |
| 4,505,201 | 3/1985 | Abele | 102/324 |

FOREIGN PATENT DOCUMENTS

| | | | |
|---|---|---|---|
| 53-133614 | 11/1978 | Japan | 102/331 |

*Primary Examiner*—Peter Nelson
*Attorney, Agent, or Firm*—Grant L. Hubbard

[57] ABSTRACT

A light weight explosive mass for a spherical charge of high explosives used to simulate nuclear bursts at ground or above ground level or underwater wherein the sphericity of the loaded explosive mass must be maintained within tight tolerance, exemplary of which are particulate ammonium nitrate/fuel oil (ANFO) explosive and liquid nitromethane explosive, contained in a flexible fabric shell that becomes spheroidal by reason of being filled with the explosive, is disclosed.

14 Claims, 1 Drawing Sheet

CONTAINER FOR A LARGE SPHERICAL EXPLOSIVE CHARGE

FIELD OF THE INVENTION

This invention relates to weapons and, more specifically, to weapons testing, namely the simulation of very high energy, e.g. nuclear, explosions using conventional explosives. More specifically, the present invention is embodied in a light weight container for a spherical charge of high explosives used to simulate nuclear bursts at ground or above ground level or underwater. Sphericity of the loaded container is maintained within tight tolerance.

BACKGROUND OF THE INVENTION

Ground level and above ground testing makes use of simulated nuclear bursts. These simulations detonate hundreds of tons of inexpensive non-nuclear explosives, typically ANFO, a mixture of ammonium nitrate and fuel oil, in a spherical geometry.

The recently used container for the granular ANFO produced undesirable effects when the explosive was detonated. The container was basically a spherical fiberglass shell, which caused reflected shocks that interfered with the desired spherical pressure wave propagation and, in addition, broke into fragments which damaged experimental setups.

Previous configurations have also included stacked bags of ANFO which do not permit above ground configurations, have non-uniform explosive densities, and present difficulties in generating a spherical detonation wave front.

An alternative system consists of a cast explosive sphere which then is suspended in a "cargo net" arrangement. This system is limited in size because of transportation problems and manufacturing problems of molds, etc.

It is an object of the present invention to provide an improved container and simulator that will simulate nuclear explosions more accurately and eliminate the hazards and inconvenience of the current practices and the prior art.

SUMMARY OF THE INVENTION

A light weight container for a spherical charge of high explosives used to simulate nuclear bursts at ground or above ground level or underwater wherein the sphericity of the loaded container must be maintained within tight tolerance is disclosed and claimed.

According to the present invention, the inert fiberglass structural shell of the prior art is replaced by a bag-like container consisting of fibrous, cloth-like material. Ideally, this material is very thin, strong, it is flexible and can be folded like cloth but does not stretch (i.e. is not rubbery), and it can be made to contain liquids without leaking (possibly by a rubberized coating process).

A design of a spherically shaped container system can be achieved such that the entire surface of the container, such as a coated woven KEVLAR® bag, remains in biaxial tension when tile container is filled with an emulsion, gelled, liquid or granular high explosive. (KEVLAR® is a registered trademark of E. I. duPont for aromatic polyamide (aramid) fibers of great strength and products manufactured from such fibers.) Analysis shows that the key to keeping all of the container's surface in biaxial tension is to support it via an attached girdle, and that tile line of attachment of the girdle must be a line of latitude on the spherical surface lying between +9° and +30° latitude, measured relative to the horizontal equator. The use of a high-strength fabric made of a fiber such as KEVLAR permits fabrication of a container having a very low inert mass fraction of the spherical charge (approx. 0.2%). The initial geometry of such a container can be adjusted so as to deform to the desired sphere upon loading. The container can be filled through a top entry port. The low mass of this container minimizes interference with the desired spherical shock wave propagation.

The flexible explosive charge container of this invention can be fabricated in a commercial shop and shipped to any desired test site. The container can be of any size desired for the test since the principles are scaleable. Explosives for the test can arrive at the test site in conventional transportation packaging and poured or pumped into the container for the test. This approach reduces overall high explosive charge costs for such tests, improves safety and handling procedures, and accomplishes the desired concept of standard, highly uniform, accurately spherical HE simulation techniques. Further, turnaround time between subsequent shots can be much shorter than with other methods.

DESCRIPTION OF THE PREFERRED EMBODIMENTS

It will be recognized that the present invention can easily be manufactured using ordinary methods and known materials once the concept and description of the invention are available. Accordingly, much of the specification and the drawings are devoted to providing a clear understanding of the invention. Accordingly, it is emphasized that the drawings and descriptions are exemplary and explanatory in nature and are not intended to provide specifics of the many well-known methods of manufacture that are available to those working in this art.

Figure 1:
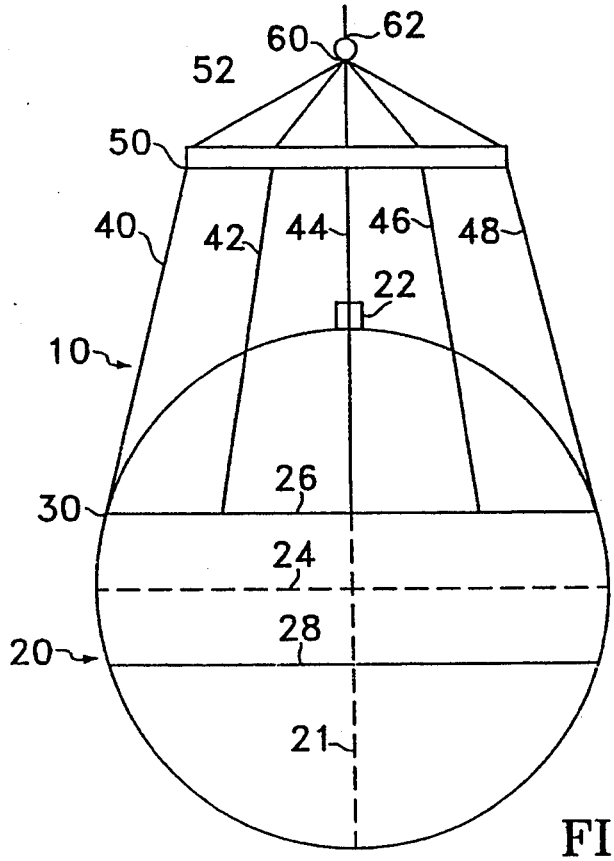
FIG. 1 depicts the container and weapon simulation device of this invention.

The overall concept of the invention can be best understood by reference to FIG. 1 which depicts, in somewhat simplified form, a weapons simulator constructed in accordance with this invention. The weapons simulator system 10 comprises a weapons simulator container 20 in the configuration approximating a sphere constructed of a fabric or film, the preferred material comprising coated KEVLAR® fabric sewn, adhesively bonded or otherwise formed in accordance with the criteria set forth hereinafter. The container 20 comprises defines a vertical axis 21 and has an opening 22 approximately in the top center to permit the container to be filled with explosive, typically a liquid such as nitromethane or an emulsion such as QM100, an emulsion consisting of ammonium nitrate, fuel oil, and water, although any explosive that can be made to flow may be used. The explosive may be in the form of a liquid, in which case the container comprises liquid proofed fabric or liquid proof film, or it may be in the form of a gel, an emulsion or particles, all of which assume a configuration that is a function of the shape of the container, the elasticity of the container and the effect of gravity, i.e. they act approximately as a liquid.

The container, when filled approximates the configuration of a sphere having a equatorial circumference 24. Additional latitudinal circumferential lines 26 and 28 are also shown in FIG. 1 to suggest the latitudinal limits at which the securement ring 30 must be defined. In use, the latitudinal circumferences, if marked on the sphere 20, would be circles defining horizontal latitudinal planes parallel to the ground and perpendicular to the vertical axis 21 of the spherical container 20. In the example depicted in FIG. 1, the securement ring 30 coincides with the latitudinal circumference 26 but, as discussed in detail below, such coincidence is not necessary. It is also pointed out here that the securement ring could lie below the plane defined by the diametrical circumference 24, e.g. at or above the latitudinal circumference 28. The securement ring may be a rigid ring secured to the fabric container or simply a latitudinal area, which may or may not be reinforced, to which support ropes or wires 40, 42, 44, 46, and 46, and additional supporting lines not shown may be secured. The supporting lines, e.g. 40, 42, 44, 46, and 48, are connected to the sphere 20 around the securement ring at spaced apart locations and extend tangentially from the sphere at the connection points, the tangential relationship being defined by any suitable means. In the example depicted in FIG. 1, a rigid support ring 50 supported by any desired number of lines, e.g. cables, wires or ropes, one of which is indicated at 52 connected to a hook or ring 60 suspended by a cable, for example, by a boom (not shown) or any other desired structure, e.g. a tower, lighter-than-air craft, a cable strung between tall trees, etc. to provide means for supporting the sphere a desired distance above the ground surface. The diameter of the hanger ring 50 is so related to the diameter of the sphere as to align the supporting lines 40–48 along tangents to the lateral circumference of the sphere to which the lines are attached.

The securement ring on the container may be positioned from approximately 30 degrees below the diameter to approximately 9 degrees above the diameter, as described more fully below. The lateral circumference 26 as depicted in FIG. 1 is not to scale and is spaced a greater distance from the diametric circumference 24 for clarity of illustration.

The collapsed and folded container is secured by ropes, wires, chains or cables to the support. Thereafter, the explosive is poured into the top of the container to fill up the container. During filling the container gradually assumes a substantially spherical configuration as described and depicted in FIG. 1.

The invention, in its embodiment as a weapon simulator, comprises a fabric (woven or non-woven), film or other flexible material in the general configuration of a sphere supported in the air, or other fluid (e.g. under water), substantially filled with an explosive each particle or molecule of which is acted separately upon by gravity, i.e., behaves as a liquid or approximately as a liquid, to expand the container to form an approximately spheroidal explosive mass supported at a multiplicity of points on the surface of the container, said support points defining generally a circle on said surface not more than about 30 degrees below nor more than about nine degrees above the diameter of the sphere.

The container comprises walls of flexible material and means for attaching the container to means for supporting the container in a fluid. The container is supported above the ground or floor in air to simulate an air burst and in water to simulate a water burst. The container walls are so constructed and configured as to define a spheroidal body when the container is substantially filled with a material that behaves approximately as a liquid. The attaching means comprises means for attaching the container at a multiplicity of points along a latitudinal line generally parallel to a diametrical circumference that is horizontal when the container is supported in use and not more than about 30 degrees below nor about 9 degrees above said diametrical circumference. The flexible material preferably comprises polyamide fiber fabric, woven or non-woven, such as is made from KEVLAR® fibers produced by E. I. dupont de Nemours, Inc. If desired, the flexible material may further comprise an organic polymeric film associated with the fabric, i.e. impregnated into, coated onto or bonded to the fabric. Rubber, natural or synthetic, is the preferred material because of its low cost, ready availability, ease of use and because it seals the fabric against leakage of typical liquid explosives such as nitromethane. The attaching means preferably comprises fabric forming a reinforcing ring around the circumference of the container as shown in FIG. 1.

In another embodiment, ready for use, the invention is an explosive mass comprising a normally non-spheroidal container, means supporting the container in fluid, the container comprising flexible walls and explosive substantially filling the container. The weight of the explosive is acted upon by gravity forcing the container into a substantially spherical configuration having a horizontal diametric circumference. The means supporting the container may comprise a multiplicity of supports secured to the container walls along latitudinal plane substantially parallel to the horizontal diametric circumference and not more than about 30 degrees below nor 9 degrees above said diametric circumference.

As described before, means supporting the container may comprise a multiplicity of elongate tensioned flexible strands, ropes, cables, wires, etc., secured to the container at their respective proximal ends and extending upwardly from the container. The distal ends of the strands may be secured to support structure of any kind. The preferred wall materials are also as described above.

FIG. 1 represents, of course, the result of a series of analyses, designs and experiments. A preliminary analysis of the feasibility of fabricating and utilizing a fabric or film structural shell was undertaken. While doubts remained even after the analysis, a tentative conclusion was reached that it would probably be technically possible to make such a structure and to use it for its intended function.

The design of the container draws on the technology of structural design and construction of large, low-pressure tires. The maximum stress in the wall would be comparable to that at its bottom, where it is just that required to contain a pressure equal to the pressure head generated by the weight of a column of explosive equal to the diameter of the spherical container. Since the density of the explosive is comparable to water and the diameter of a typical sphere is in the range 20 to 35 ft, the equivalent gas pressure to be contained by the container wall is between 10 and 16 psi. For a 20 ft.-diameter sphere, this results in a tensile stress in the wall of about 500 lb/in, specifying the required strength of the piles of fabric.

Contrary to a gas-filled tire, the stress in the wall in this case is a function of height, since the pressure is generated by the action of gravity on a dense medium. This will also tend to distort the shape of the shell from its initial shape; if the initial shape is spherical, elastic distortion of the fabric will result in a non-spherical shape. If a final spherical shape is desired, the initial fabric shape must be selected to be the one which will elastically distort into a sphere under the anticipated load.

Figure 2:
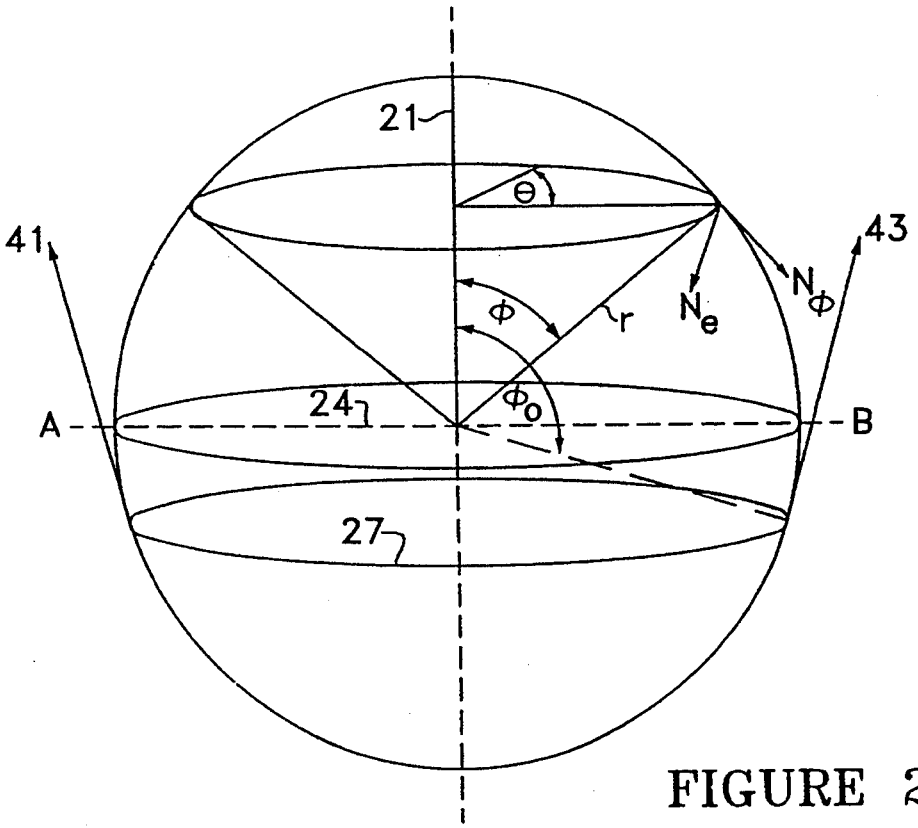
FIG. 2 is a geometric depiction of the device of this invention for reference in explaining the design parameters and experimental data contained in the specification.

The analytical investigation proceeded along the following lines, reference being made at a number of points to FIG. 2, wherein lines 41 and 43 are depicted to indicate multiple tangential support lines extending upwardly and, in this case, divergingly from a lateral circumference 27. To see what fabric stretch does to the shape of the sphere, assume that (1) the main explosive inside the shell behaves as a liquid, and (2) stretching of the fabric causes the sphere to assume an oblate spheroidal shape. In reality, neither assumption is quite correct. If the main explosive is granular and likely to behave more like sand, the distorted shape of the sphere will not be a perfect oblate spheroid. However, in order to gain some insight into the magnitudes involved, these assumptions will be used.

For a spherical shell, the volume, $V_s$ and surface area, $A_s$ are given in terms of the radius, r, as follows $$V_s=(4/3)\pi r^3;\ A_s=4\pi r^2 \tag{1}$$

For an oblate spheroid with major and minor semi-axes of a and b respectively and an eccentricity $\epsilon$, the volume V and surface area A are given by $$V=(4/3)\pi a^2 b;\ A=2\pi a^2+(\pi b^2/\epsilon)\ln[(1+\epsilon)/(1-\epsilon)] \tag{2}$$

Assuming the volume remains the same as the sphere distends into a spheroid then $$V=V_s \text{ or } a^2 b=r^3. \tag{3}$$

Also by definition of eccentricity, $$\epsilon=(1/a)\sqrt{(2^2-b^2)}, \tag{4}$$

so that $$b=a\sqrt{(1-\epsilon^2)}. \tag{5}$$

From (3) and (5)

$$a/r=1/(1-\epsilon^2)^{1/6};\ b/r=(1-\epsilon^2)^{\frac{1}{3}}, \tag{6}$$

and from (1) and (2)

$$A/A_s=(\tfrac{1}{2})(a/r)^2+(\tfrac{1}{4})(b/r)^2(1/\epsilon)\ln[(1+\epsilon)/(1-\epsilon)], \tag{7}$$

or substituting (6) in (7)

$$A/A_s=(\tfrac{1}{2})(1-\epsilon^2)^{-\frac{1}{3}}+(1-\epsilon^2)^{\frac{2}{3}}/4\epsilon]\ln[(1+\epsilon)/(1-\epsilon)-]. \tag{8}$$

Table 1 shows how the sphere is distorted with different area changes.

TABLE 1

| Area Change of Oblate Spheroid for Constant Volume | | |
|---|---|---|
| $\epsilon$ | $b/a(A/As)^{-1}$ | |
| 0.1 | 0.9950 | $4.493 \times 10^{-6}$ |
| 0.2 | 0.9798 | $7.430 \times 10^{-5}$ |
| 0.3 | 0.9539 | $3.983 \times 10^{-4}$ |
| 0.4 | 0.9165 | 0.001370 |
| 0.5 | 0.8660 | 0.003763 |
| 0.6 | 0.8000 | 0.009172 |
| 0.7 | 0.7141 | 0.02126 |
| 0.8 | 0.6000 | 0.05034 |
| 0.9 | 0.4359 | 0.14005 |

Thus, if an eccentricity of 0.3 is allowable, such that b/a=0.9539, then the allowed surface stretch is 0.04%.

For a sphere suspended at its equator the shape assumed is approximately a prolate spheroid (cigar shaped). In that case Eq (2) becomes $$V=(4/3)\pi ab^2;\ A=2\pi b^2+(2\pi ab/\epsilon)\sin^{-}\epsilon \tag{2'}$$

Eq (3) then becomes $$ab^2=r^3, \tag{3'}$$

and Eq (8) becomes $$A/a_s=(\tfrac{1}{2})(1-\epsilon^2)^{\frac{1}{3}}+(1-\epsilon^2)^{-1/6}(\sin^{-1}\epsilon)/(2\epsilon). \tag{8'}$$

The corresponding table is Table 2

TABLE 2

| Area Change of Prolate Spheroid for Constant Volume | | |
|---|---|---|
| $\epsilon$ | $b/a(A/As)^{-1}$ | |
| 0.1 | 0.9950 | $4.486 \times 10^{-6}$ |
| 0.2 | 0.9798 | $7.382 \times 10^{-5}$ |
| 0.3 | 0.9539 | $3.923 \times 10^{-4}$ |
| 0.4 | 0.9165 | 0.001332 |
| 0.5 | 0.8660 | 0.003569 |
| 0.6 | 0.8000 | 0.008546 |
| 0.7 | 0.7141 | 0.01911 |
| 0.8 | 0.6000 | 0.04283 |
| 0.9 | 0.4359 | 0.10792 |

Comparing oblate and prolate spheroids, the area increases are quite similar for eccentricities E<0.5.

Next consider a sphere suspended as shown in FIG. 2. Let the stresses along the longitudes and latitudes by $N_\phi$ and $N_\theta$ respectively, per unit length. These stresses are those required to generate the forces on the fluid of density, $\rho$, to support it in the earth's gravitational field. Let the shell portion above the line of suspension, (AB), be the Upper Shell and that below it, the Lower Shell. Then the forces are given as:

Upper Shell ($o<\phi<\phi_o$):

$$N_\phi=(\rho r^2/6)[(1-2\cos^2\phi/(1+\cos\phi)] \tag{9}$$

$$N_\theta=(\rho r^2/6)[5-6\cos\phi+2\cos^2\phi/(1+\cos\phi)]. \tag{10}$$

Lower Shell ($\phi_o<\phi<180°$):

$$N_\phi=(\rho r^2/6)[5+2\cos^2\theta/(1-\cos\phi)] \tag{11}$$

$$N_{74}=(\rho r^2/6)[1-6\cos\phi-2\cos^2\phi/(1-\cos\phi)]. \tag{12}$$

Assume the weight of the explosive V=240,000 lb and its density is $\rho=62.4$ lb/ft$^3$ (same as water, then $r\approx116.6$ in. and $\rho r^2/6=81.9$ lb/in. Using these numbers, Table 3 shows the $N_\phi$, $N_\theta$ values for the Upper and Lower Shells for different values of $\phi$.

TABLE 3

| Stress Distribution in Upper and Lower Shells | | | | | |
|---|---|---|---|---|---|
| | UPPER SHELL | | | LOWER SHELL | |
| $\phi$ deg | $N_\phi$ lb/in | $N_\theta$ lb/in | | $N_\phi$ lb/in | $N_\theta$ lb/in |
| 0 | 0 | 0 | | | negative |
| 10 | 1.86 | 5.60 | | | negative |
| 20 | 7.33 | 22.30 | | | negative |
| 30 | 16.06 | 49.76 | | | negative |
| 40 | 27.47 | 87.48 | | | negative |
| 50 | 40.70 | 134.81 | | | negative |
| 60 | 54.59 | 191.07 | | | negative |
| 70 | 67.61 | 255.66 | | | negative |
| 80 | 77.68 | 328.32 | ($\approx 81°$) | 414.21 | 0 |
| 90 | 81.89 | 409.43 | | 409.43 | 81.89 |
| 100 | 75.91 | 500.72 | | 413.64 | 162.99 |
| 110 | 52.77 | 606.58 | | 423.70 | 235.65 |
| 120 | 0 | 736.97 | | 436.72 | 300.25 |
| 130 | negative | | | 450.60 | 356.51 |
| 140 | negative | | | 463.85 | 403.84 |
| 150 | negative | | | 475.25 | 441.55 |
| 160 | negative | | | 483.98 | 469.02 |
| 170 | negative | | | 489.45 | 485.71 |
| 180 | negative | | | 491.32 | 491.32 |

Since the fabric cannot sustain compression without buckling, the value of $\phi°$, i.e. the suspension latitude, must lie between $\phi° \approx 81°$ and $\phi° \approx 120°$. Outside these limits either $N_\phi$ or $N_\theta$ become negative, signifying that the force is compressive in one dimension.

We now estimate the amount of fabric required, assuming it to be made of Kevlar with the following properties:

TABLE 4

| | | |
|---|---|---|
| Specific tensile strength | = | $9.5 \times 10^6$ in. |
| Density | $\rho k$ = | 0.053 lb/in$^3$ |
| Elastic Modulus | E = | $27 \times 10^6$ lb/in$^2$ |
| Strain to failure | $e_f$ = | 1.3% |

Assuming an initial geometry with an eccentricity $\epsilon=0.5$, designed to deform into a sphere, then the allowed area change is ~0.4%, representing a unidirectional strain of e=0.2%.

This means that the working stress must be, assuming that Poisson's ratio is 0.5

$$\sigma_w = 2Ee = 2 \times 27 \times 10^6 \times 0.002 = 108{,}000 \text{ psi.}$$

Assuming maximum values for $N_\phi$ and $N_\theta$ of 500 lb/in, then the required thickness of a unidirectional Kevlar film is $t_1=(500)/(108{,}000)$ in.=0.00463 in. Applying a small safety factor and doubling the thickness to allow for two directional strength, then $t \approx 0.01$ in.

Assuming that this thickness is uniformly applied along the sphere's surface, then the weight of the Kevlar is $$W_k = 4\pi r^2 t \rho_k = 90 \text{ lb.}$$

Application of an additional safety factor and use of a woven fabric geometry rather than film will probably result in a fabric thickness of the order of 0.1 in. and a fabric weight of 400–500 lb. We envision the joining of pieces of fabric cut to appropriate patterns to give the required initial shape and joined together by sewing in the manner of fabricating a parachute or the skin fabric of a blimp or by adhesive bonding as is common in joining the fabric pieces of flexible liquid containers. The seams will, of course, have to be strong enough to sustain the 500 lb/in maximum stress value, but this is feasible. The total equivalent mass thickness of 0.020 to 0.040 n. of Kevlar film is considered to be a small enough quantity that it is likely to be vaporized or consumed and that it also will have a negligible effect on shock wave reflection.

In an initial test of the design concept, the container intended to be filled with nitromethane was tested for its sphericity. The container design specified that sphericity should be maintained to within plus or minus 2% of nominal. The test was designed to ascertain the radii of 25–35 points on the surface of the container to a "best fit" container center.

In a preliminary evaluation, a container as described was filled with water and elevated to waist height. A transit was set up about 50 feet from the container and a 'witness board' was erected about 3 feet behind the container (from the transit) and surveyed to be normal to the transit. Readings were then taken by the transit to points on the circumference and the witness board was marked accordingly. After all readings were made, the container was rotated through 90 degrees and an additional series of readings was made and marked on a new witness board. It should be noted that although parallax was present and is somewhat significant at the transit standoff distance, it is irrelevant since it is relative differences in radii that are to be measured; also, there was some tendency for the container to swing in the breeze, accounting for some error. Readings were impossible at locations at which the suspension system interfered with the view and were meaningless at the filler port. A mark was placed on the witness board marking the vertical and top; this reference was surveyed. Additionally, in one viewing direction, the level of the filler port was marked.

The witness boards were recovered and each marked point was numbered. The conformance to the 2% requirement was made in the following manner: A circle was drawn such that the circle would be as close to as many points as possible. The distance of each point from the center of the circle was then calculated by measuring the x and y coordinates of each point relative to the circle center. X and y coordinates were measured rather than just the radius (z) so as to provide information on the location of each point. X and y coordinates were measured to the nearest 1/32 of an inch. The fractional part of each dimension was converted to decimal and is provided in the following table, along with the calculated radius, z.

TABLE 5

| ORIENTATION #1 | | | |
|---|---|---|---|
| POINT # | X-COORDINATE | Y-COORDINATE | RADIUS, IN |
| 1 | 5.938 | 17.875 | 18.84 |
| 2 | 7.000 | 17.188 | 18.56 |
| 3 | 7.875 | 16.688 | 18.45 |
| 4 | 8.844 | 16.125 | 18.39 |
| 5 | 11.469 | 14.375 | 18.39 |
| 6 | 14.281 | 11.906 | 18.59 |
| 7 | 15.313 | 10.281 | 18.44 |
| 8 | 18.000 | 3.438 | 18.33 |
| 9 | 18.250 | −1.313 | 18.30 |
| 10 | 17.500 | −4.563 | 18.09 |
| 11 | 16.313 | −8.250 | 18.28 |
| 12 | 14.063 | −11.500 | 18.17 |
| 13 | 11.188 | −14.438 | 18.27 |
| 14 | 6.750 | −17.063 | 18.35 |
| 15 | 2.969 | −18.063 | 18.31 |
| 16 | −0.219 | −18.250 | 18.25 |
| 17 | −4.188 | −17.938 | 18.42 |
| 18 | −7.938 | −16.438 | 18.25 |
| 19 | −11.094 | −14.313 | 18.11 |
| 20 | −14.313 | −11.000 | 18.11 |

TABLE 5-continued

| POINT # | ORIENTATION #1 X-COORDINATE | Y-COORDINATE | RADIUS, IN |
|---|---|---|---|
| 21 | −16.625 | −7.531 | 18.05 |
| 22 | −17.750 | −3.813 | 18.15 |
| 23 | −18.219 | 0.594 | 18.23 |
| 24 | −17.813 | 4.500 | 18.37 |
| 25 | −15.250 | 9.750 | 18.10 |
| 26 | −12.500 | 13.375 | 18.31 |
| 27 | −9.188 | 15.875 | 18.34 |
| 28 | −6.875 | 16.750 | 18.11 |
| 29 | −6.250 | 17.000 | 18.11 |
| 30 | −5.563 | 17.250 | 18.12 |
| 31 | −5.250 | 17.219 | 18.00 |

Mean radius = 18.26 in.
Max allowable (+2%) = 18.63 in.
Min allowable (−2%) - 17.89 in.

TABLE 6

| POINT # | ORIENTATION #2 X-COORDINATE | Y-COORDINATE | RADIUS, IN |
|---|---|---|---|
| 1 | 5.813 | 17.625 | 18.56 |
| 2 | 10.031 | 15.063 | 18.10 |
| 3 | 13.188 | 12.563 | 18.21 |
| 4 | 15.813 | 9.125 | 18.26 |
| 5 | 16.188 | 8.250 | 18.17 |
| 6 | 18.000 | 3.000 | 18.25 |
| 7 | 18.000 | −0.750 | 18.02 |
| 8 | 17.438 | −4.750 | 18.07 |
| 9 | 15.938 | −8.500 | 18.06 |
| 10 | 13.563 | −11.938 | 18.07 |
| 11 | 10.625 | −14.594 | 18.05 |
| 12 | 5.813 | −17.500 | 18.44 |
| 13 | 0.813 | −18.500 | 18.52 |
| 14 | 3.438 | −18.250 | 18.57 |
| 15 | 7.875 | −16.563 | 18.34 |
| 16 | −11.938 | −13.625 | 18.12 |
| 17 | −15.313 | −9.625 | 18.09 |
| 18 | −17.219 | −5.438 | 18.06 |
| 19 | −18.125 | −1.500 | 18.19 |
| 20 | −18.000 | 3.375 | 18.31 |
| 21 | −15.750 | 9.063 | 18.17 |
| 22 | −13.500 | 12.250 | 18.23 |
| 23 | −10.563 | 14.875 | 18.24 |
| 24 | −8.375 | 16.250 | 18.28 |
| 25 | −7.125 | 16.750 | 18.20 |
| 26 | −6.563 | 16.938 | 18.17 |
| 27 | −6.000 | 17.125 | 18.15 |

Mean radius = 18.22 in.
Max allowable (+2%) = 18.58 in.
Min allowable (−2%) - 17.86 in.

Sphericity Analysis

Given points $x_i$, $y_i$, $i=1,2,\ldots,N$ that lie approximately on a circle. Determine by means of least squares the center of the circle, (a,b), and its radius, r.

Solution: The equation of a circle is $$(x-a)^2+(y-b)^2=r^2 \tag{1}$$

Let the deviation be defined as $$d_i=r^2-(x_i-a)^2-(y_i-b)^2 \tag{2}$$

We now set $$\frac{\partial}{\partial r}\sum_{i=1}^{N} d_i^2 = 0 = 4r\sum_{I=1}^{N}[r^2-(x_i-a)^2-(y_i-b)^2] \tag{4}$$

$$\frac{\partial}{\partial a}\sum_{i=1}^{N} d_i^2 = 0 = 4\sum_{I=1}^{N}(x_i-a)[r^2-(x_i-a)^2-(y_i-b)^2] \tag{5}$$

-continued $$\frac{\partial}{\partial b}\sum_{i=1}^{N} d_i^2 = 0 = 4\sum_{I=1}^{N}(y_i-b)[r^2-(x_i-a)^2-(y_i-b)^2] \tag{6}$$

We now expand Eqs. (4), (5) and (6)

$$\sum_{i=1}^{N} x_i^2 - 2a\sum_{i=1}^{N} x_i + \sum_{i=1}^{N} y_i^2 - 2b\sum_{i=1}^{N} y_i = N(r^2-a^2-b^2) \tag{7}$$

$$\sum_{i=1}^{N} x_i^3 - 2a\sum_{i=1}^{N} x_i^2 + \sum_{i=1}^{N} x_iy_i^2 - 2b\sum_{i=1}^{N} x_iy_i = \sum_{i=1}^{N} x_i(r^2-a^2-b^2) \tag{8}$$

$$\sum_{i=1}^{N} x_i^2y_i - 2a\sum_{i=1}^{N} x_iy_i + \sum_{i=1}^{N} y_i^3 - 2b\sum_{i=1}^{N} y_i^2 = \sum_{i=1}^{N} y_i(r^2-a^2-b^2) \tag{9}$$

Eliminating the $r^2-a^2-b^2$ factor between Eqs (7) and (8) and between Eqs (7) and (9) results in two equations with a and b as unknowns.

$$2a\left[\sum_{i=1}^{N} x_i\sum_{i=1}^{N} x_i - N\sum_{i=1}^{N} x_i^2\right] + 2b\left[\sum_{i=1}^{N} x_i\sum_{i=1}^{N} y_i - N\sum_{i=1}^{N} x_iy_i\right] = \sum_{i=1}^{N} x_i\sum_{i=1}^{N} x_i^2 + \sum_{i=1}^{N} x_i\sum_{i=1}^{N} y_i^2 - N\sum_{i=1}^{N} x_i^3 - N\sum_{i=1}^{N} x_iy_i^2 \tag{10}$$

$$2a\left[\sum_{i=1}^{N} y_i\sum_{i=1}^{N} x_i - N\sum_{i=1}^{N} x_iy_i\right] + 2b\left[\sum_{i=1}^{N} y_i\sum_{i=1}^{N} y_i - N\sum_{i=1}^{N} y_i^2\right] = \sum_{i=1}^{N} y_i\sum_{i=1}^{N} x_i^2 + \sum_{i=1}^{N} y_i\sum_{i=1}^{N} y_i^2 - N\sum_{i=1}^{N} x_i^2y_i - N\sum_{i=1}^{N} y_i^3 \tag{11}$$

$$A_i = 2\left[\sum_{i=1}^{N} x_i\sum_{i=1}^{N} x_i - N\sum_{i=1}^{N} x_i^2\right] \tag{12}$$

$$B_i = 2\left[\sum_{i=1}^{N} x_i\sum_{i=1}^{N} y_i - N\sum_{i=1}^{N} x_iy_i\right] \tag{13}$$

$$C_i = \sum_{i=1}^{N} x_i\sum_{i=1}^{N} x_i^2 + \sum_{i=1}^{N} x_i\sum_{i=1}^{N} y_i^2 - N\sum_{i=1}^{N} x_i^3 - N\sum_{i=1}^{N} x_iy_i^2 \tag{14}$$

$$A_2 = 2\left[\sum_{i=1}^{N} y_i\sum_{i=1}^{N} x_i - N\sum_{i=1}^{N} x_iy_i\right] \tag{15}$$

$$B_2 = 2\left[\sum_{i=1}^{N} y_i\sum_{i=1}^{N} y_i - N\sum_{i=1}^{N} y_i^2\right] \tag{16}$$

$$C_2 = \sum_{i=1}^{N} y_i\sum_{i=1}^{N} x_i^2 + \sum_{i=1}^{N} y_i\sum_{i=1}^{N} y_i^2 - N\sum_{i=1}^{N} x_i^2y_i - N\sum_{i=1}^{N} y_i^3 \tag{17}$$

Note that $B_1 = A_2$, then Equations (10) and (11) become $$aA_1 + bB_1 = C_2 \tag{18}$$

$$aB_1 + bB_2 = C_2 \tag{19}$$

Whose solution is $$a = \frac{C_1B_2 - C_2B_1}{A_1B_2 - B_1^2} \tag{20}$$

$$b = \frac{C_2A_1 - C_1B_1}{A_1B_2 - B_1^2} \tag{21}$$

r is then obtained from Eq (7), namely $$r = \sqrt{a^2 + b^2 + \frac{1}{N}\left[\sum_{i=1}^{N} x_i^2 - 2a\sum_{i=1}^{N} x_i + \sum_{i=1}^{N} y_i^2 - 2b\sum_{i=1}^{N} y_i\right]} \tag{22}$$

We used the deviation of the square of the radius, i.e. $d_i$ in Eq (2), to solve for a, b and r. To obtain the deviations of the radius, we define $$D_i = r - \sqrt{(x_i - a)^2 + (y_i - b)^2} \tag{23}$$

and use the following equation to obtain the standard deviation of the radius $$D_{std} = \sqrt{\frac{\Sigma D_i^2}{N}} \tag{24}$$

TABLE 6

| Results: | Orientation #1 | Orientation #2 |
|---|---|---|
| a = | 0.099 | −0.026 |
| b = | 0.057 | −0.018 |
| r = | 18.282 | 18.218 |
| 2%xr = | 0.366 | 0.364 |
| $D_{std}$ = | 0.157 | 0.147 |

The above results were computed on a spreadsheet as shown in Table 7 and Table 8.

SPHERICITY ANALYSIS

| POINT | X | Y | X 2 | X 3 | Y 2 | Y 3 | X*Y | X 2*Y | X*Y 2 | D 2 | D |
|---|---|---|---|---|---|---|---|---|---|---|---|
| | | | | | ORIENTATION #1 | | | | | | |
| 1 | 5.938 | 17.875 | 35.260 | 209.37 | 319.516 | 5711.34 | 106.142 | 630.27 | 1897.28 | 0.2188 | −0.4677 |
| 2 | 7.000 | 17.188 | 49.000 | 343.00 | 295.427 | 5077.81 | 120.316 | 842.21 | 2067.99 | 0.0346 | −0.1861 |
| 3 | 7.875 | 16.688 | 62.016 | 488.37 | 278.489 | 4647.43 | 131.418 | 1034.92 | 2193.10 | 0.0058 | −0.0765 |
| 4 | 8.844 | 16.125 | 78.216 | 691.75 | 260.016 | 4192.75 | 142.610 | 1261.24 | 2299.58 | 0.0001 | −0.0110 |
| 5 | 11.469 | 14.375 | 131.538 | 1508.61 | 206.641 | 2970.46 | 164.867 | 1890.86 | 2369.96 | 0.0000 | −0.0008 |
| 6 | 14.281 | 11.906 | 203.947 | 2912.57 | 141.753 | 1687.71 | 170.030 | 2428.19 | 2024.37 | 0.0391 | −0.1979 |
| 7 | 15.313 | 10.281 | 234.488 | 3590.71 | 105.699 | 1086.69 | 157.433 | 2410.77 | 1618.57 | 0.0023 | −0.0476 |
| 8 | 18.000 | 3.438 | 324.000 | 5832.00 | 11.820 | 40.64 | 61.884 | 1113.91 | 212.76 | 0.0042 | 0.0651 |
| 9 | 18.250 | −1.313 | 333.063 | 6078.39 | 1.724 | −2.26 | −23.962 | −437.31 | 31.46 | 0.0064 | 0.0799 |
| 10 | 17.500 | −4.563 | 306.250 | 5359.38 | 20.821 | −95.01 | −79.853 | −1397.42 | 364.37 | 0.0776 | 0.2786 |
| 11 | 16.313 | −8.250 | 266.114 | 4341.12 | 68.063 | −561.52 | 134.582 | −2195.44 | 1110.30 | 0.0041 | 0.0643 |
| 12 | 14.063 | −11.500 | 197.768 | 2781.21 | 132.250 | −1520.88 | −161.725 | −2274.33 | 1859.83 | 0.0244 | 0.1562 |
| 13 | 11.188 | −14.438 | 125.171 | 1400.42 | 208.456 | −3009.69 | −161.532 | −1807.22 | 2332.20 | 0.0010 | 0.0321 |
| 14 | 6.750 | −17.063 | 45.563 | 307.55 | 291.146 | −4967.82 | −115.175 | −777.43 | 1965.24 | 0.0071 | −0.0842 |
| 15 | 2.969 | −18.063 | 8.815 | 26.17 | 326.272 | −5893.45 | −53.629 | −159.22 | 968.70 | 0.0040 | −0.0636 |
| 16 | −0.219 | −18.250 | 0.048 | −0.01 | 333.063 | −6078.39 | 3.997 | −0.88 | −72.94 | 0.0008 | −0.0275 |
| 17 | −4.188 | −17.938 | 17.539 | −73.45 | 321.772 | −5771.94 | 75.124 | −314.62 | −1347.58 | 0.0468 | −0.2164 |
| 18 | −7.938 | −16.4387 | 63.012 | −500.19 | 270.208 | −4441.68 | 130.485 | −1035.79 | −2144.91 | 0.0044 | −0.0666 |
| 19 | −11.094 | −14.313 | 123.077 | −1365.41 | 204.862 | −2932.19 | 158.788 | −1761.60 | −2272.74 | 0.0045 | 0.0674 |
| 20 | −14.313 | −11.000 | 204.862 | −2932.19 | 121.000 | −1331.00 | 157.443 | −2253.48 | −1731.87 | 0.0138 | 0.1173 |
| 21 | −16.625 | −7.531 | 276.391 | −4594.99 | 56.716 | −427.13 | 125.203 | −2081.50 | −942.90 | 0.0068 | −0.0827 |
| 22 | −17.750 | −3.813 | 315.063 | −5592.36 | 14.539 | −55.44 | 67.681 | −1201.33 | −258.07 | 0.0003 | 0.0185 |
| 23 | −18.219 | 0.594 | 331.932 | −6047.47 | 0.353 | 0.21 | −10.822 | 197.17 | −6.43 | 0.0019 | −0.0436 |
| 24 | −17.813 | 4.500 | 317.303 | −5652.12 | 20.250 | 91.13 | −80.159 | 1427.86 | −360.71 | 0.0297 | −0.1725 |
| 25 | −15.250 | 9.750 | 232.563 | −3546.58 | 95.063 | 926.86 | −148.688 | 2267.48 | −1449.70 | 0.0166 | 0.1290 |
| 26 | −12.50 | 13.375 | 156.250 | −1953.13 | 178.891 | 2392.66 | −167.188 | 2089.84 | −2236.13 | 0.0026 | −0.0507 |
| 27 | −9.188 | 15.875 | 84.419 | −775.64 | 252.016 | 4000.75 | −145.860 | 1340.16 | −2315.52 | 0.0036 | −0.0603 |
| 28 | −6.875 | 16.750 | 47.266 | −324.95 | 280.563 | 4699.42 | −115.156 | 791.70 | −1928.87 | 0.0366 | 0.1913 |
| 29 | −6.250 | 17.000 | 39.063 | −244.14 | 289.000 | 4913.00 | −106.250 | 664.06 | −1806.25 | 0.0357 | 0.1890 |
| 30 | −5.563 | 17.250 | 30.947 | −172.16 | 297.563 | 5132.95 | −95.962 | 533.84 | −1655.34 | 0.0328 | 0.1812 |
| 31 | −5.250 | 17.219 | 27.563 | −144.70 | 296.494 | 5105.33 | −90.400 | 474.60 | −1556.59 | 0.0938 | 0.3063 |
| SUM = | 6.718 | 55.716 | 4668.503 | 1957.11 | 5700.441 | 15588.75 | 82.479 | 3701.50 | 1229.16 | 0.7606 | 0.0208 |
| | | | | | ORIENTATION #2 | | | | | | |
| 1 | 5.813 | 17.265 | 33.791 | 196.43 | 310.641 | 5475.04 | 102.454 | 595.57 | 1805.75 | 0.1339 | −0.3659 |
| 2 | 10.031 | 15.063 | 100.621 | 1009.33 | 226.894 | 3417.70 | 151.097 | 1515.65 | 2275.97 | 0.0083 | 0.0913 |
| 3 | 13.188 | 12.563 | 173.923 | 2293.70 | 157.829 | 1982.81 | 165.681 | 2185.00 | 2081.45 | 0.0007 | −0.0273 |
| 4 | 15.813 | 3.125 | 250.051 | 3954.06 | 83.266 | 759.80 | 144.294 | 2281.72 | 1316.68 | 0.0050 | −0.0706 |
| 5 | 16.188 | 8.250 | 262.051 | 4242.09 | 68.063 | 561.52 | 133.551 | 2161.92 | 1101.80 | 0.0003 | 0.0174 |
| 6 | 18.000 | 3.000 | 324.000 | 5832.00 | 9.000 | 27.000 | 54.000 | 972.00 | 162.00 | 0.0035 | −0.0593 |
| 7 | 18.000 | −0.750 | 324.000 | 5832.00 | 0.563 | −0.42 | −13.500 | −243.00 | 10.13 | 0.0312 | 0.1767 |
| 8 | 17.438 | −4.750 | 304.084 | 5302.61 | 22.563 | −107.17 | −82.831 | −1444.40 | 393.44 | 0.0153 | 0.1237 |
| 9 | 15.938 | −8.500 | 254.020 | 4048.57 | 72.250 | −614.13 | −135.473 | −2159.17 | 1151.52 | 0.0196 | 0.1399 |
| 10 | 13.563 | −11.938 | 183.955 | 2494.98 | 142.516 | −1701.35 | −161.915 | −2196.05 | 1932.94 | 0.0199 | 0.1412 |
| 11 | 10.265 | −14.594 | 112.891 | 1199.46 | 212.985 | −3108.30 | −155.061 | −1647.53 | 2262.96 | 0.0271 | 0.1645 |
| 12 | 5.813 | −17.500 | 33.791 | 196.43 | 306.250 | −5359.38 | −101.728 | −591.34 | 1780.23 | 0.0458 | −0.2140 |
| 13 | 0.813 | −18.500 | 0.661 | 0.54 | 342.250 | −6331.63 | −15.041 | −12.23 | 278.25 | 0.0804 | −0.2836 |

-continued

SPHERICITY ANALYSIS

| POINT | X | Y | X 2 | X 3 | Y 2 | Y 3 | X*Y | X 2*Y | X*Y 2 | D 2 | D |
|---|---|---|---|---|---|---|---|---|---|---|---|
| 14 | −3.438 | −18.200 | 11.820 | −40.64 | 331.240 | −6028.57 | 62.572 | −215.12 | −1138.80 | 0.0794 | −0.2818 |
| 15 | −7.875 | −16.563 | 62.016 | −488.37 | 274.333 | −4543.78 | 130.434 | −1027.16 | −2160.37 | 0.0090 | 0.0947 |
| 16 | −11.938 | −13.625 | 142.516 | −1701.35 | 185.641 | −2529.35 | 162.655 | −1941.78 | −2216.18 | 0.0178 | 0.1334 |
| 17 | −15.313 | −9.625 | 234.488 | −3590.71 | 92.641 | −891.67 | 147.388 | −2256.95 | −1418.61 | 0.0265 | 0.1629 |
| 18 | −17.219 | −5.438 | 296.494 | −5105.33 | 29.572 | −160.81 | 93.637 | −1612.33 | −509.20 | 0.0365 | 0.1911 |
| 19 | −18.125 | −1.500 | 328.516 | −5954.35 | 2.250 | −3.38 | 27.188 | −492.77 | −40.78 | 0.0034 | 0.0587 |
| 20 | −18.000 | 3.375 | 324.000 | −5832.00 | 11.391 | 38.44 | −60.750 | 1093.50 | −205.03 | 0.0053 | −0.0730 |
| 21 | −13.500 | 12.250 | 182.250 | −2460.38 | 150.063 | 1838.27 | −165.375 | 2232.56 | −2025.84 | 0.0000 | −0.0038 |
| 23 | −10.563 | 14.875 | 111.577 | −1178.59 | 221.0266 | 3291.33 | −157.125 | 1659.71 | −2337.23 | 0.0006 | −0.0251 |
| 24 | −8.375 | 16.250 | 70.141 | −587.43 | 264.063 | 4291.02 | −136.094 | 1139.79 | −3211.52 | 0.0045 | 0.0668 |
| 25 | −7.125 | 16.750 | 50.766 | −361.71 | 280.563 | 4699.42 | −119.344 | 850.32 | −1999.01 | 0.0001 | 0.0097 |
| 26 | −6.563 | 46.938 | 43.073 | −282.69 | 286.896 | 4859.44 | −111.164 | 729.57 | −1882.90 | 0.0021 | 0.0461 |
| 27 | −6.000 | 17.125 | 36.000 | −216.00 | 293.266 | 5022.17 | −105.450 | 616.50 | −1759.59 | 0.0041 | 0.0644 |
| SUM = | 1.439 | 30.769 | 4499.556 | 4895.67 | 4460.387 | 5628.44 | −285.942 | 442.16 | −465.61 | 0.5842 | 0.0160 |

A1 = −289357 a = 0.099
B1 = −4365.08 b = 0.057
C1 = −28929.9 r = 18.282
B2 = −347219 2%*r = 0.366
C2 = −20231.7 D std = 0.157
A1 = −242972 a = −0.026
B1 = 15529.43 b = −0.018
C1 = 6141.715 r = 18.218
B2 = −238967 2%*r = 0.364
C2 = 3782.134 D std = 0.147

The invention is embodied in a container that, when empty, is not in a spheroidal configuration, i.e. in a non-spheroidal configuration, and means for securing support structure to the container generally circumferentially around the container, the container being so constructed and configured as to define a spheroidal body when filled with material that behaves generally as a liquid, the means for securing support structure defining a ring not more than approximately 30 degrees below nor more than about 9 degrees above the diameter of said spheroidal body. Geometric terms are used to describe and define the configuration of the container when full with full recognition that while the terms are geometrically descriptive as applied such terms are not rigorous geometric definitions in the pure mathematical sense. Thus, the terms are used in a qualified manner. "Spheroidal" is used in the normal sense to mean shaped approximately as a sphere but not necessarily forming a perfect sphere. The empty container is described as being non-spheroidal meaning that without being filled as described the container would not be sufficiently spheroidal to function effectively and efficiently in a weapon simulator. Obviously, the container would if inflated with air, for example, have some resemblance to a sphere but would not, in that configuration, define an efficient weapon simulator explosive mass. "Circumference" and such derivatives of that term as "latitudinal plane" are used to describe the circle defined by slicing a spheroidal body at any plane, including but not limited to the diametrical plane. Materials are described as behaving generally like a liquid when they conform to the shape of the container and are constrained in the bottom of the container and exert different forces upon different portions of the container at different levels of the material as a result of gravity. Each particle, physical molecule in the case of true liquids, globules or micella in the case of gels and the like, grains in the case of sand-like materials, is said to be acted upon separately by gravity such as to seek the lowest level available to the particle. The density of water, 62.4 lb/ft$^3$, is used as a general reference in defining the materials that, when filling the container, cause the container to become spheroidal. Other densities may be accommodated with little or no redesign and only minor design changes, in accordance with the analysis and design criteria described, are required to accommodate lighter or heavier materials.

The invention is also embodied in a weapon simulator that comprises the container as defined above filed with an explosive as defined and supported in the manner defined.

INDUSTRIAL APPLICATION

This invention is useful in evaluating the effects of nuclear and large, high energy explosions in fluid, air or water, using low-cost readily available explosive materials.

What is claimed is:

1. A container comprising walls of flexible material and means for attaching the container to means for supporting the container in a fluid, the container walls being so constructed and configured as to define a spheroidal body when the container is substantially filled with a material that behaves approximately as a liquid, the attaching means comprising means for attaching the container at a multiplicity of points along a latitudinal plane generally parallel to a diametrical circumference that is horizontal when the container is supported in use and not more than about 30 degrees below nor about 9 degrees above said latitudinal plane, the attaching means applying supporting force substantially tangentially to the surface of the spherical body.

2. The container of claim 1 wherein the flexible material comprises polyamide fiber fabric.

3. The container of claim 2 wherein the flexible material further comprises an organic polymeric film associated with the fabric.

4. The container of claim 3 wherein the polymeric film is rubber.

5. The container of claim 1 wherein the flexible material further comprises an organic polymeric film associated with the fabric.

6. The container of claim 5 wherein the polymeric film is rubber.

7. An explosive mass comprising a normally non-spheroidal container, means supporting the container in fluid, the container comprising flexible walls, explosive substantially filling the container, the weight of the explosive acted upon by gravity forcing the container into a substantially spherical configuration having a horizontal diametric circumference, the means supporting the container comprise a multiplicity of supports secured to the container walls along a latitudinal plane substantially parallel to the horizontal diametric circumference and not more than about 30 degrees below nor 9 degrees above said diametric circumference.

8. The explosive mass of claim 7 wherein the means supporting the container comprises a multiplicity of elongate tensioned flexible strands secured to the container at their respective proximal ends and extending upwardly from the container.

9. The explosive mass of claim 7 wherein the flexible material comprises polyamide fiber fabric.

10. The explosive mass of claim 9 wherein the flexible material further comprises an organic polymeric film associated with the fabric.

11. The explosive mass of claim 10 wherein the polymeric film is rubber.

12. The explosive mass of claim 7 wherein the flexible material further comprises an organic polymeric film associated with the fabric.

13. The explosive mass of claim 12 wherein the polymeric film is rubber.

14. The explosive mass of claim 7 wherein the means supporting the explosive mass comprises a multiplicity of elongate tensioned flexible strands secured to the explosive mass at their respective proximal ends and extending upwardly from the explosive mass providing supporting force substantially tangentially to the surface of the mass.

* * * * *